US007845134B2

(12) United States Patent
Lacey, Jr.

(10) Patent No.: US 7,845,134 B2
(45) Date of Patent: Dec. 7, 2010

(54) STRUCTURE AND A METHOD FOR CONSTRUCTING THE STRUCTURE

(76) Inventor: Harvey W. Lacey, Jr., 108 Eastridge Ct., Wylie, TX (US) 75098

( * ) Notice: Subject to any disclaimer, the term of this patent is extended or adjusted under 35 U.S.C. 154(b) by 676 days.

(21) Appl. No.: 11/249,643

(22) Filed: Oct. 13, 2005

(65) Prior Publication Data

US 2007/0062150 A1 Mar. 22, 2007

(51) Int. Cl.
*E04H 12/00* (2006.01)

(52) U.S. Cl. ..... 52/655.1; 52/653.2

(58) Field of Classification Search ..... 52/648.1, 52/653.2, 655.1, 745.01, 745.17; 403/206, 403/234, 237, 192, 196, 235, 190, 49; 256/65.02, 256/65.13; 248/228.1, 230.1, 72, 541; 211/107; 108/151; 182/186.7, 186.8
See application file for complete search history.

(56) References Cited

U.S. PATENT DOCUMENTS

| | | | | | |
|---|---|---|---|---|---|
| 2,737,267 | A | | 3/1956 | Koch | |
| 3,511,011 | A | | 5/1970 | Straus | |
| 3,771,269 | A | * | 11/1973 | Lerch et al. | 52/93.2 |
| 3,955,801 | A | * | 5/1976 | Soriero, Jr. | 256/65.13 |
| 3,979,862 | A | * | 9/1976 | Hamilton et al. | 52/93.2 |
| 4,039,264 | A | * | 8/1977 | Sharp | 403/246 |
| 4,041,659 | A | * | 8/1977 | McElhoe | 52/93.1 |
| 4,445,307 | A | * | 5/1984 | Puccinelli et al. | 52/638 |
| 4,467,586 | A | * | 8/1984 | Long et al. | 52/748.1 |
| 4,800,698 | A | * | 1/1989 | Murphy | 52/714 |
| 4,923,176 | A | * | 5/1990 | Heinz | 256/65.06 |
| 5,028,164 | A | * | 7/1991 | Williams | 403/246 |
| 5,127,757 | A | * | 7/1992 | Langer | 403/49 |
| 5,207,527 | A | * | 5/1993 | Duncan et al. | 403/246 |
| 5,411,113 | A | * | 5/1995 | Lubinski | 182/186.7 |
| 5,560,730 | A | * | 10/1996 | Gillard et al. | 403/294 |
| 5,605,204 | A | * | 2/1997 | Ausejo | 182/186.7 |
| 5,660,376 | A | * | 8/1997 | West | 256/22 |
| 5,894,909 | A | * | 4/1999 | Cornish | 182/186.8 |
| 5,918,700 | A | * | 7/1999 | Gregory | 182/186.8 |
| 6,027,276 | A | * | 2/2000 | Schworer | 403/49 |
| 6,375,164 | B1 | * | 4/2002 | Siegler et al. | 256/1 |
| 6,401,426 | B1 | * | 6/2002 | Alderman et al. | 52/749.12 |
| 6,527,256 | B2 | * | 3/2003 | Doyle, Jr. | 256/65.02 |
| 6,575,534 | B2 | * | 6/2003 | Chen | 297/411.43 |
| 6,688,430 | B1 | * | 2/2004 | Wallther | 182/186.8 |
| 7,048,093 | B2 | * | 5/2006 | Wallther | 182/186.7 |
| 2004/0046162 | A1 | * | 3/2004 | Zhu | 256/65.03 |
| 2006/0157302 | A1 | * | 7/2006 | van den Goorbergh | 182/186.8 |

* cited by examiner

*Primary Examiner*—Richard E Chilcot, Jr.
*Assistant Examiner*—Andrew J Triggs
(74) *Attorney, Agent, or Firm*—Jackson Walker L.L.P.; Sara K. Borrelli

(57) ABSTRACT

A structure and a method for producing the structure wherein the structure comprises a framework of purlins supported by clips and plates and upright cylindrical members to form a structure of a fence, wall or a structure and the method comprises supporting the purlins between cylindrical members by the use of clips and plates to produce a structure which may include a slanted or peaked roof and may include windows and doors.

8 Claims, 6 Drawing Sheets

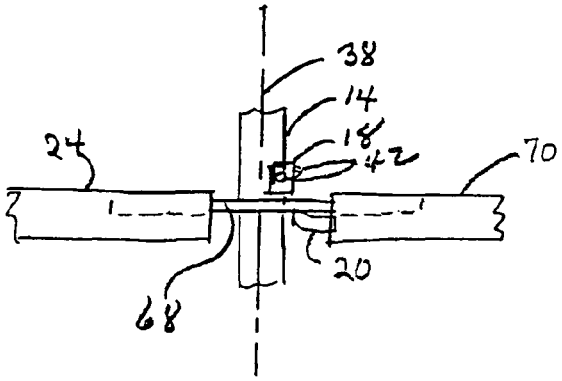
FIGURE 10
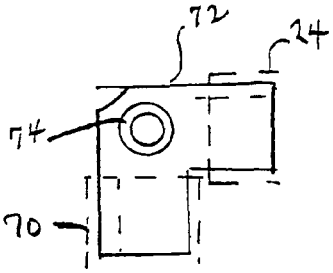
FIGURE 12
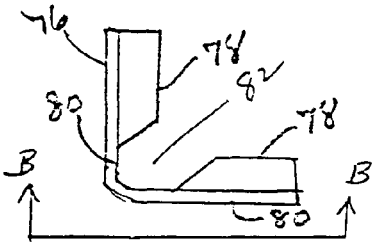
FIGURE 13
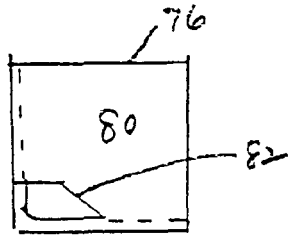
FIGUREE 14
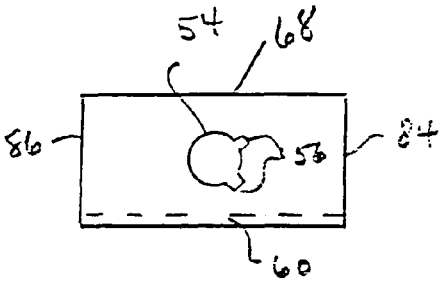
FIGURE 11
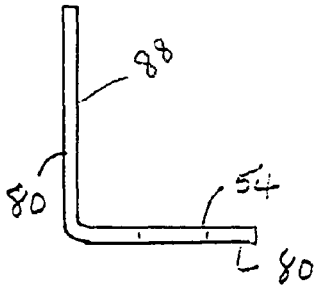
FIGURE 15

STRUCTURE AND A METHOD FOR CONSTRUCTING THE STRUCTURE

FIELD OF THE INVENTION

The present invention relates to a conveniently constructed structure which can be constructed by the method of the present invention by inexperienced individuals using few tools and a method for constructing the structures.

BACKGROUND OF THE INVENTION

In many instances, individuals who have retired or who have recently moved to rural areas or individuals in urban areas are interested in constructing buildings as do-it-yourself projects. While the present invention is extremely useful and adapted to individuals who wish to construct buildings themselves, it is also well adapted to the construction of building by professionals who may use the method of the present invention to economically and efficiently construct structures. The structures may be buildings, walls, fences and the like.

In the past, the construction of buildings has required the use of welding, complicated bracket and bolt assemblies and the like.

According to the present invention, a simple method is provided for constructing a structure using tools such as a saw, a screw driver, a power screw driver, self-tapping screws and the like.

SUMMARY OF THE INVENTION

According to the present invention, a method is provided for constructing a structure comprising: positioning a plurality of cylindrical members in an upright position; positioning a clip including an arcuate section adapted to matingly engage one of the cylindrical members at a selected location and a tab positioned on a first end of the clip to extend outwardly from the cylindrical member in a selected orientation when the arcuate section is positioned on the cylindrical member, the tab being adapted to support a plate on the cylindrical member at a selected location; positioning a plate having an opening adapted to fit closely around at least a portion of the cylindrical member and having at least one slot extending from a circumference of the opening and adapted to permit passage of a tab therethrough at a selected location; and, supporting a purlin on a clip and a plate on each of at least two cylindrical members to support the purlin in a selected position relative to the two cylindrical members.

The invention further includes a structure comprising: a plurality of cylindrical members in an upright position; a plurality of clips each having a first end positioned on at least two of the cylindrical members at selected locations, each of the clips comprising an arcuate section adapted to matingly engage one of the cylindrical members at a selected location and a tab positioned on the first end of the clip extending outwardly from the cylindrical member in a selected orientation when the clip is positioned in mating engagement with the cylindrical members; a plurality of plates having an opening adapted to fit closely around one of the cylindrical members and having at least one slot extending outwardly from a circumference of the opening and adapted to permit passage of a tab therethrough and positioned on a tab of a clip; and, a plurality of purlins supported at a selected location between at least a portion of the upright cylindrical members by a clip and a plate to form the building structure.

The invention also provides a connection for joining purlins comprising two plates orthogonally joined at their ends with each of the plates having a flange along one of its sides with an opening positioned at a selected angle through each flange and into each plate along the side of the plate at a selected angle for a distance equal to up to one third of width of each plate.

BRIEF DESCRIPTION OF THE DRAWINGS

FIG. 10 shows an alternate arrangement wherein a plate is used to support a purlin on each side of a pipe;

FIG. 11 is a top view of the plate shown in FIG. 10;

FIG. 12 is a plate adapted for positioning around a cylinder to form a corner in a structure;

FIG. 13 is a top view of a connector for connecting two purlins;

FIG. 14 is an end view of the connector of FIG. 13, taken at lines BB;

FIG. 15 is an end view of a plate for mounting a purlin with its wide surface parallel to an axis of the cylindrical member.

DESCRIPTION OF PREFERRED EMBODIMENTS

In the discussion of the Figures, the same numbers will be used throughout to refer to the same or similar components.

The present invention is directed to a system for assembling component parts of a structure, which may be a wall, a fence or a complete building comprising walls, windows and a roof produced by the method of the present invention. The present invention is directed primarily to the construction of the structure, i.e., skeletal components of a building and it not limited to any particular type of siding, roof material or the like.

Figure 1:
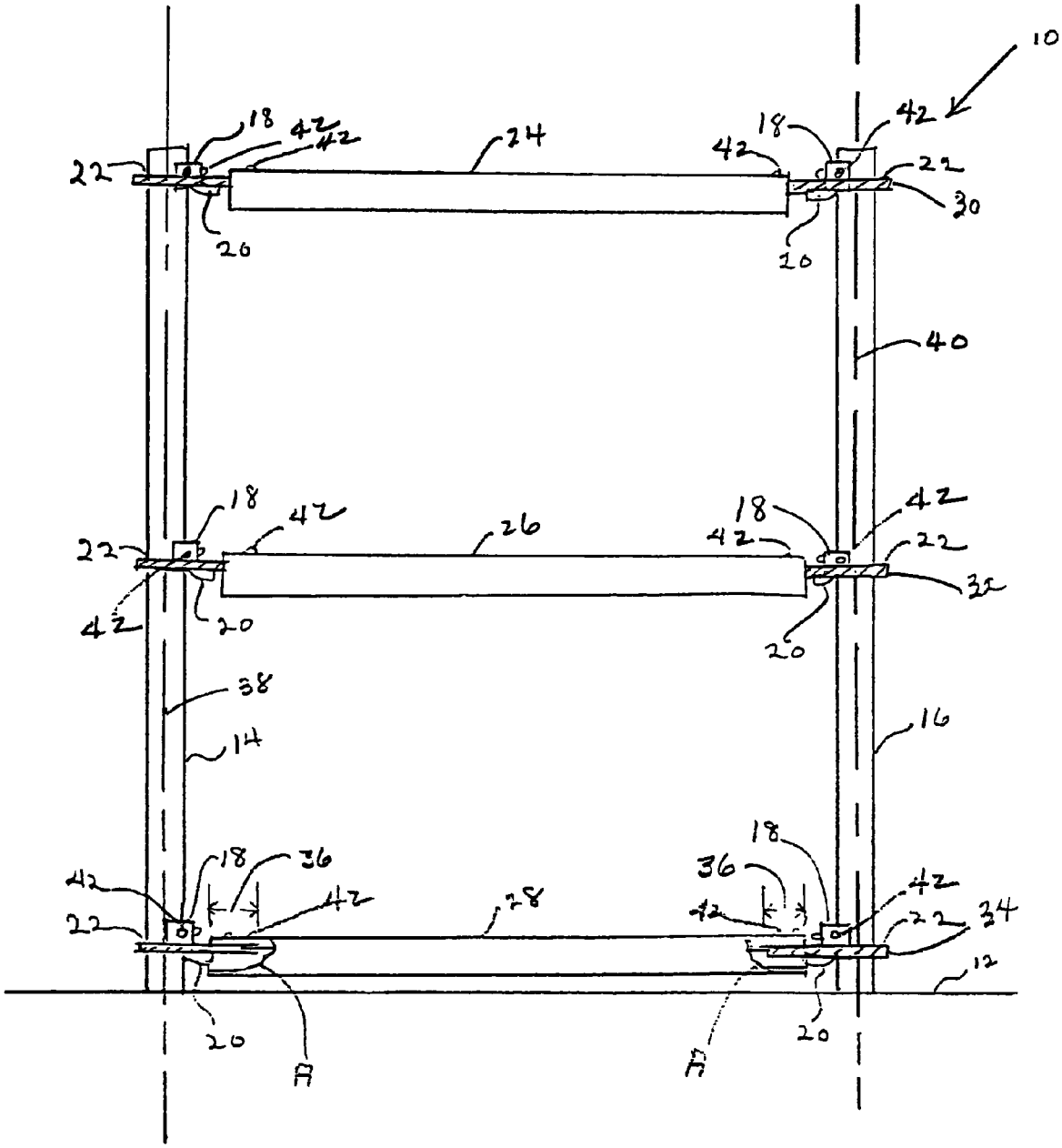
FIG. 1 is a side view of a frame construction for a wall comprising two cylindrical members and supported purlins.

In FIG. 1, a structure 10 is shown and comprises first and second cylindrical supports 14 and 16 having a first axis 38 and a second axis 40, which are supported from a surface 12 which may be a cement floor, an earth surface, a structural member (not shown), especially if it is desired to move structure 10 after completion of the structure or the like. The structure is completed by positioning clips 18 at selected locations on first and second cylindrical supports 14 and 16 as shown. The clips are discussed in detail subsequently but generally comprise an arcuate portion 44 fastened to a surface of a cylindrical support using screws to position a tab 20 on a bottom 50 of arcuate portion 44 relative to a cylindrical support. A plate 22, which is also discussed subsequently in more detail, is then positioned around a cylindrical support and supported in position on the cylindrical support by tab 20. A plurality of clips and plates are used to support purlins at selected locations on first and second cylindrical supports 14 and 16. Purlins 24, 26 and 28 are shown positioned at selected locations 30, 32 and 34 to form a frame which may be covered with an exterior siding material or any other desired material.

In cutaways shown at A, the plates are shown engaging purlin 28. Desirably the distance 36 by which the ends of purlin 28 overlie plates 22 is at least one inch up to about 4 inches, although longer overlaps are not undesirable. As shown, the clips 18 are retained in position by screws 42 with plates 22 being secured to purlins 24, 26 and 28 by screws 42. These screws are desirably self-tapping screws and are readily used to secure clips 18 to cylindrical supports 14 and 16. The only tools required to construct the structure shown in FIG. 1 are a saw or other device for cutting purlins and a screw driver for use to install the plates and clips as described herein. Clearly individuals who wish to produce structures for their own use can readily do so using the method of the present invention to produce structures according to the present invention.

Figure 2:
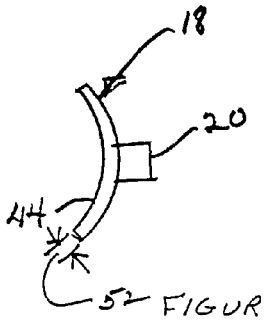
FIG. 2 is a top view of a clip used in the construction shown in FIG. 1.
Figure 3:
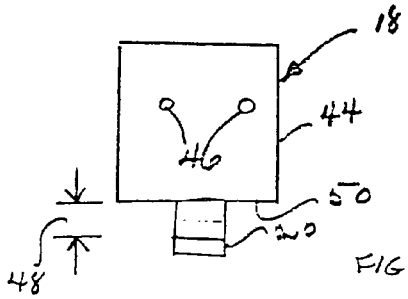
FIG. 3 is a front view of the clip shown in FIG. 2.
Figure 4:
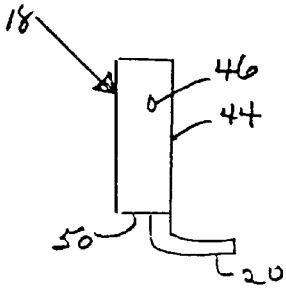
FIG. 4 is a side view of the clip shown in FIG. 2.

In FIG. 2, a more detailed top view of a clip is shown. The clip includes an arcuate portion 44 which is curved to fit a section of a cylindrical member. As shown in FIG. 3, the arcuate portion is fastened to the cylindrical member by screws 42 which may be positioned through openings 46 to fasten the arcuate portion 44 to a cylindrical member. Arcuate portion 44 includes a bottom 50 which as positioned on a cylindrical member and used to secure a plate, provides a space 48 which is equal to or slightly greater than the thickness of the plate so that the tab 20 extends to support the plate in position as described below while providing space to restrain upward movement of the plate relative to clip 18. This feature is shown in more detail in FIG. 4. The tab has a thickness sufficient to support a plate 22.

Figure 5:
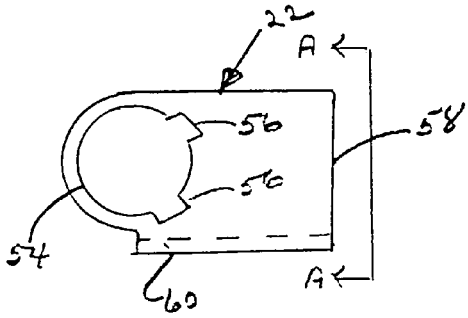
FIG. 5 is a top view of a plate useful with the clip shown in FIG. 2.

In FIG. 5 a plate 22 is shown. Plate 22 includes an opening 54 which includes two slots 56 which may be positioned as desired and an end 58. The slots are positioned to facilitate passage of tab 20 through the plate so that when the plate is rotated, the tab is beneath the plate. The slots permit the positioning of the plate with opening 54 being no larger than required for passage over the outside of a cylindrical support. When the plate is rotated after passage of the tab through the plate, then the bottom 50 of the clip retains the plate in position relative to upward movement while the tab restricts movement of the plate in the opposite direction.

Figure 6:
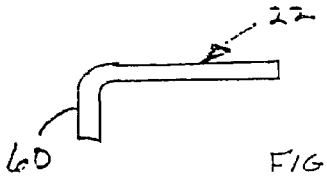
FIG. 6 is an end view of the plate shown in FIG. 5, taken at line AA.

In FIG. 6 an end view of plate 22 of FIG. 5 is shown. The end view shows a flange 60 positioned on one side of plate 22. This flange is positioned to interact with a flange on purlins 24, 26 and 28. This facilitates the positioning of the purlins on plate 22. Desirably the purlins are fastened to plate 22 or a similar plate by screws which are desirably self-tapping screws which facilitate the assembly of the component parts.

Figure 7:
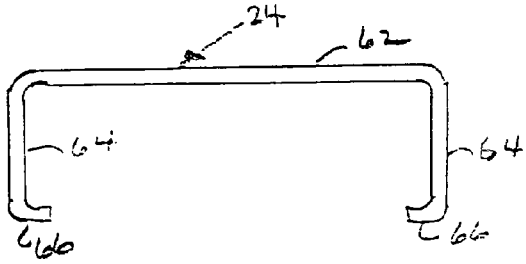
FIG. 7 is an end view of a purlin.

In FIG. 7 an end view of a purlin 70, as known to the art, is shown. Purlins are available in a variety of lengths and are readily cut to a desired length. The purlin includes a flat portion 62 which is generally positioned on a top or a side as the purlin is installed. The purlin further includes side portions 64 with flanges 66 on the ends of side portions 64. This construction provides an element which may be used as pipes or 2"×4" wood boards are used in other constructions to form longitudinal members between cylindrical supports and perform other functions such as rafters and the like in construction in the method of the present invention.

Figure 8:
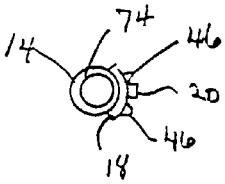
FIG. 8 is a top view of a pipe having a clip mounted to the pipe.

In FIG. 8, a cylindrical support which is desirably a pipe, but could be a solid wooden support, a solid metal support or the like is shown. As shown the cylindrical member comprises a pipe 74 with a clip 18 positioned on the pipe. Screws 42 are used to hold arcuate portion 44 of clip 18 on the cylindrical member. As shown, tab 20 extends outwardly from cylindrical member 14 to form a tab 20 which retains a plate in position as discussed previously.

Figure 9:
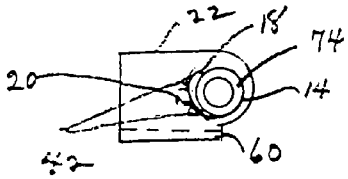
FIG. 9 is a top view of a pipe, including a clip positioned as shown in FIG. 8, with a plate, as shown in FIG. 5, positioned on the pipe.

FIG. 9 shows a plate 22 as shown in FIG. 5 in position on a cylindrical pipe 74. As positioned, plate 22 is held in position by tab 20, shown as a dotted line, and the bottom of arcuate portion 44.

It will be understood that the plate can take a variety of configurations and as shown for instance in FIG. 10 a plate 68 is shown which extends in two directions from cylindrical support 14. This plate is held in position by a single clip, although two clips could be used as desired, and supports two purlins 24 and 70. The use of the clip and plate is as described previously with the variation being that the plate is adapted to support a purlin on each side of the cylindrical member.

In FIG. 11 a top view of plate 68 as shown in FIG. 10 is shown. Plate 68 includes an opening 54, two tabs 56 and includes ends 84 and 86, both of which are capable of supporting a purlin.

In FIG. 12 a further variation is shown of plate 72 adapted to position purlins at a selected location on a pipe 74 at right angles. While this plate is shown to position the purlins at right angles, it will be understood that other angles could also be used. This plate also may be supported by a single clip. In an alternate embodiment, the purlins at a corner could be supported as shown in FIG. 1 for supporting the purlins on each of the cylindrical members.

FIG. 13 shows a junction plate 76 which is useful to join purlins at a 90° angle. While this junction plate has been shown for a 90° angle, it will be understood that other angles could be used as well. The junction plate comprises two plates 80 designed to slip inside the ends of two purlins. The junction plate also includes flanges 78 designed to interact with flanges 64 on the sides of the purlins.

FIG. 14 shows a view taken from line BB as shown in FIG. 13, an opening is position at 82 which comprises angular sides extending through each of the flanges and upwardly at an angle through a corner of each of the plates 80 adjoining the flanges. The angle can be of any suitable angle and the clip is desirably positioned so that the junction plate can be bent to any desired angle. The flanges interact with the sides of the purlin to secure a firm connection.

In FIG. 15 an angled plate 88 is shown. Angled plate 88 comprises two plate surfaces 80 which include an opening 54, as better shown in FIG. 16, with an opening 54, including tabs 20 positioned on one of the sides so that one of the plates 80 is available in an upright position to connect a purlin in a position so that the flat surface 62 of the purlin is fastened by screws to the upright plate 80.

Figure 17:
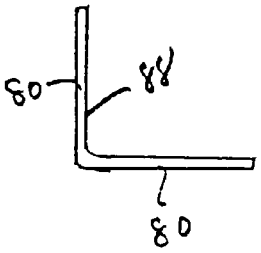
FIG. 17 is a top view of a connector for purlins comprising two plates, which are positioned orthogonally to each other.

In FIG. 17 a plate is shown having flanges joined at a 90° angle which permits the installation of purlins on a supporting purlin surface. A first flange 80 is positioned flat on a purlin surface or a horizontal or angled purlin surface with a second purlin being fastened to the second plate in both cases with the connections simply being made by screw connections.

Figure 18:
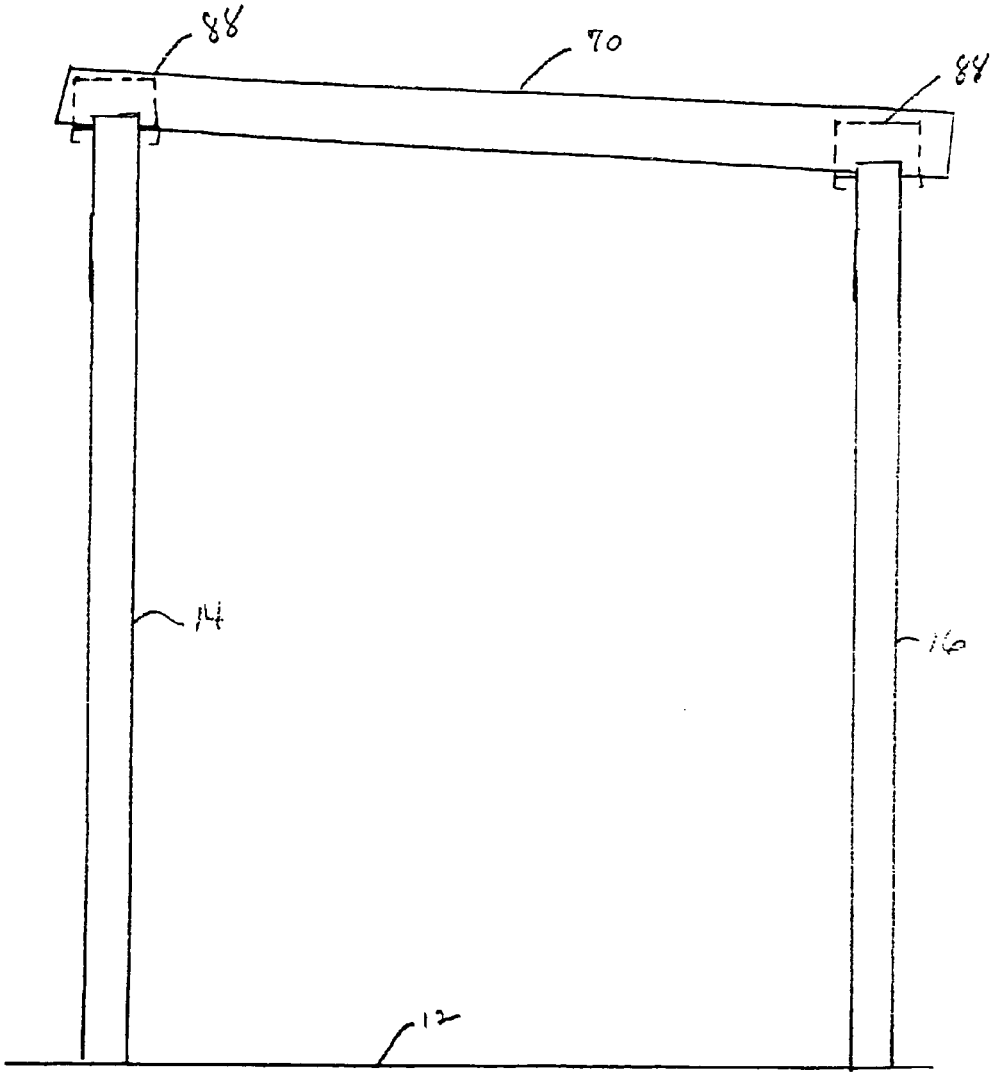
FIG. 18 is a schematic diagram of a purlin positioned on two cylindrical members to form a sloped roof for a building structure.

In FIG. 18 a schematic diagram is presented showing first and second cylindrical supports included in a wall, supporting a purlin 70 to form rafters for a slanted roof. Flanges 88 are shown as supporting the ends of purlin 70 at the top of cylindrical supports 14 and 16. While not shown, these plates may be of the configuration shown in FIG. 16 for support on cylindrical supports 14 and 16. Alternatively, if purlins 70 are desirably supported between cylindrical supports 14 and 16, plates such as shown in FIG. 17 may be used. This embodiment will be further discussed in connection with FIG. 18.

Figure 19:
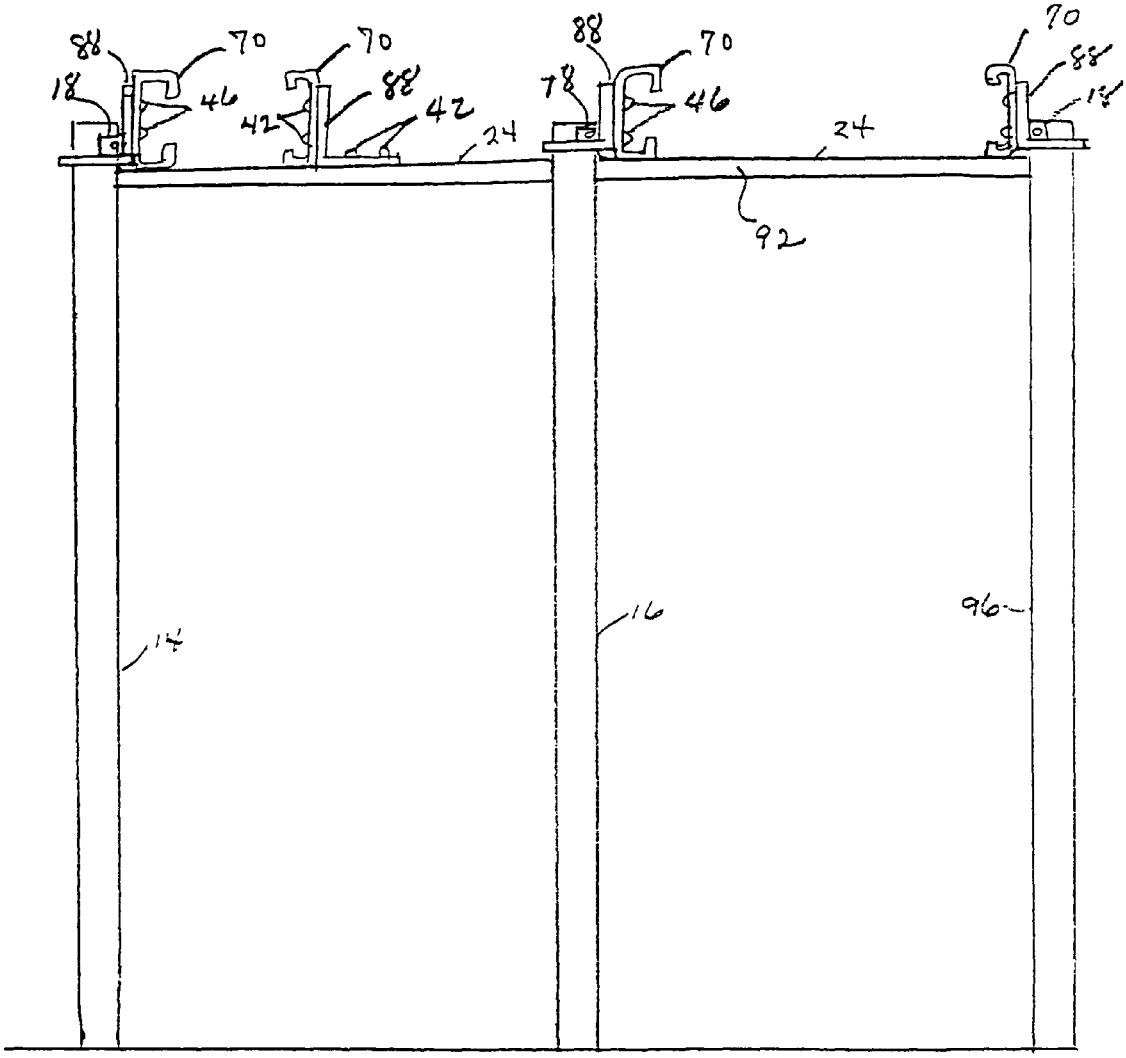
FIG. 19 is a schematic diagram of three cylindrical members positioned to support purlins at the cylindrical members and on a horizontal purlin at a location intermediate to the cylindrical members.

In FIG. 19 a view of a wall comprising cylindrical supports 14 and 16 and a third cylindrical support 96 is shown. Purlins 70 are supported as discussed, at the tops of the cylindrical members by the use of a clip and plate with the purlins being screwed to the plate. To position purlins at an intermediate level supported by a horizontal purlin, an angled plate 88 as discussed above in connection with FIG. 17 is used. By the use of screws, this plate can be fastened to a top surface of a purlin 24 and to a second purlin 70 joined to angle plate 88 at a selected angle. This enables the use of purlins as roof rafters for either a slanted roof construction, as discussed above or an angled roof construction as shown in FIGS. 20 and 21.

Figure 16:
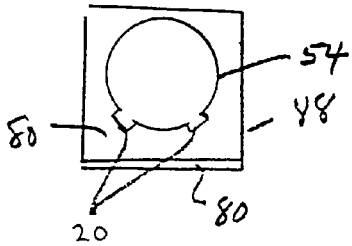
FIG. 16 is a side view of a plate, including a first plate and a second plate, including an opening adapted for positioning over a clip on a cylindrical member.
Figure 20:
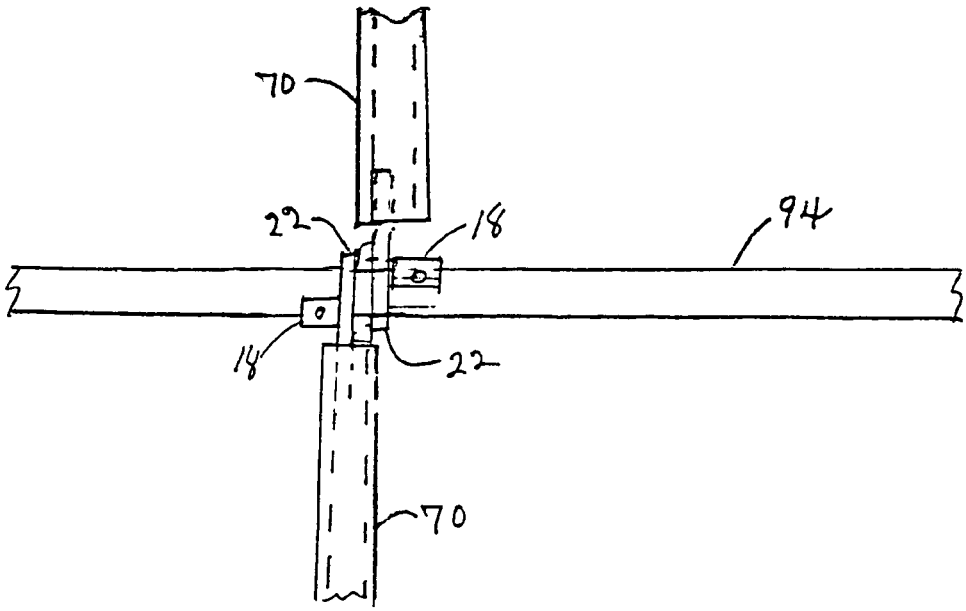
FIG. 20 is a schematic diagram of a junction of two purlins at two clips on a roof pipe; and, FIG. 21 is a side view of the embodiment shown in FIG. 20.
Figure 21:
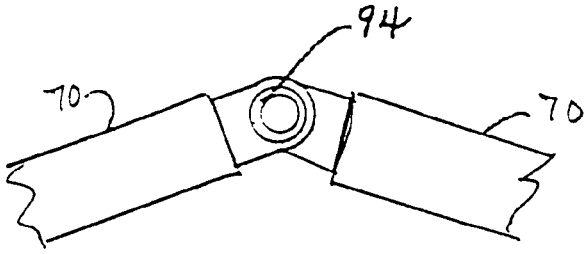

In FIGS. 20 and 21 a roof pipe 94 is supported as desired by supporting a purlin from a cylindrical member using a clip and a plate as shown for instance in FIG. 16 or by an extended cylindrical support or the like. A peaked roof is then produced by the use of a clip and a plate such as shown in FIG. 5 with a purlin at the roof pipe 94. As mentioned previously, clips 18 secure purlins 70 at a selected location on pipe 94 by interaction of the tabs and the bottoms of the arcuate plates comprising the clips. The purlins are then locked in place on roof pipe 94 so that neither of the purlins can move along the length of roof pipe 94. This permits purlins to be used as rafters at any selected angle, as shown for instances in FIG. 21.

As discussed previously, by the use of the clip and plate connection system of the present invention, a variety of plates can be used to connect purlins to the cylindrical members by the use of simple tools such as specifically a screw driver. These members may be wood cylinders, pipes, or the like and are preferably pipes. A drill could be used if desired but is generally not necessary with the use of self-tapping screws. Further the purlins can be cut to length with a simple saw so that homeowners or other do-it-yourselfers can produce structures without the need for complicated and expensive equipment or construction skills.

As indicated previously, the construction of the clips is such that the diameter of the openings 54 is sized to fit closely around the cylindrical member. Desirably the diameter of the opening 54 is slightly greater than the diameter of the cylindrical member.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for constructing a structure consisting essentially of:

a) positioning a plurality of cylindrical members in an upright position;

b) positioning a clip including an arcuate section adapted to matingly engage an outer circumference of one of the cylindrical members at a selected location, the clip including a tab positioned on a bottom of the clip extending downwardly for a distance in a parallel orientation to the axis of the cylindrical member to form a downward portion and extending outwardly in a perpendicular orientation to the axis of the cylindrical member to form a support portion, wherein when the clip is positioned on the cylindrical member, the tab is positioned to support a plate at a selected location;

c) positioning a plate having a thickness and an opening with a circular shape and a circumference adapted to surround the cylindrical member and a clip positioned on the cylindrical member, the opening having at least one slot extending from the circumference of the opening and adapted to engage the downward portion of the tab to allow the opening to be positioned to surround the outer circumference of the cylindrical member below the clip, wherein in a selected orientation the downward portion of the tab fits within the slot and the plate rests on the support portion of the tab, wherein the thickness of the plate is equal to or less than the distance of the downward portion, wherein the plate is positioned between the bottom of the clip and the support portion of the tab to restrict upward movement of the plate relative to the clip, and wherein the downward portion of the tab is positioned within the slot to restrict lateral movement of the plate relative to the clip; and d) supporting a purlin on a plate on each of at least two cylindrical members to support the purlin in a selected position relative to the two cylindrical members.

2. The method of claim 1 wherein a plurality of clips and plates are positioned on a plurality of cylindrical members positioned to comprise a building structure to support a plurality of purlins to form a frame work for the building structure.

3. The method of claim 2 wherein the building structure comprises a sloped roof produced by supporting a plurality of purlin rafters from a higher elevation on a first side of the building structure than on a second side of the building structure.

4. The method of claim 3 wherein at least a portion of the purlins are supported by clips and plates from cylindrical members in the sides of the building structure.

5. The method of claim 3 wherein at least a portion of the purlins are supported by plates from purlins between cylindrical members.

6. The method of claim 1 wherein the structure has a peaked roof and is produced by supporting a roof cylindrical member at a selected height above a top of the building structure walls and between a first side of the structure and a second side of the structure from cylindrical members or a purlin and connecting purlins to the roof cylindrical member by clips and plates and to tops of the first and second sides by clips and plates to a top of cylindrical member or by plates to purlins.

7. The method of claim 1 wherein a plurality of clips and plates are positioned on a plurality of cylindrical members positioned to comprise a wall to support a plurality of purlins to form a frame work for the wall.

8. The method of claim 1 wherein a plurality of clips and plates are positioned on a plurality of cylindrical members positioned to comprise a fence to support a plurality of purlins to form a frame work for the fence.

* * * * *